US005169250A

United States Patent [19]

Tsuru et al.

[11] Patent Number: 5,169,250

[45] Date of Patent: Dec. 8, 1992

[54] PRINTER HAVING CONTINUOUS PAPER/CUT PAPER CHANGEOVER APPARATUS

[75] Inventors: Yoshio Tsuru, Kani; Yuuji Kawahara, Nagoya, both of Japan

[73] Assignee: Brother Kogyo Kabushiki Kaisha, Nagoya, Japan

[21] Appl. No.: 849,100

[22] Filed: Mar. 9, 1992

[30] Foreign Application Priority Data

Apr. 11, 1991 [JP] Japan ..... 3-106770

[51] Int. Cl.[5] ..... B41J 11/50

[52] U.S. Cl. ..... 400/605; 400/611; 400/625; 400/636.2

[58] Field of Search ..... 400/605, 611, 618, 624, 400/625, 636, 636.1, 636.2, 621

[56] References Cited

U.S. PATENT DOCUMENTS

| | | | |
|---|---|---|---|
| 3,625,333 | 12/1971 | Cortona | 400/605 |
| 4,360,279 | 11/1982 | Sugiura | 400/618 |
| 4,417,517 | 11/1983 | Matsuda et al. | 400/605 |
| 4,425,047 | 1/1984 | Narushima | 400/605 |
| 4,498,795 | 2/1985 | Tatara | 400/631 |
| 4,569,611 | 2/1986 | Watanabe et al. | 400/624 |
| 4,606,663 | 8/1986 | Christoph et al. | 400/605 |
| 4,688,957 | 8/1987 | Prevignano | 400/605 |
| 4,729,683 | 3/1988 | Staniszewski | 400/624 |
| 4,743,132 | 5/1988 | Chikata et al. | 400/629 |
| 4,798,374 | 7/1989 | Ito | 400/625 |
| 4,859,098 | 8/1989 | Kawashima et al. | 400/611 |
| 4,881,837 | 11/1989 | Falconieri | 400/625 |
| 4,896,979 | 1/1990 | Nolte et al. | 400/605 |
| 4,909,497 | 3/1990 | Itabashi et al. | 400/605 |
| 4,936,695 | 6/1990 | Ishii | 400/605 |
| 4,981,377 | 1/1991 | Hasagawa et al. | 400/605 |
| 4,987,112 | 12/1990 | Yokoi | 400/629 |
| 4,995,745 | 2/1991 | Yokoi et al. | 400/605 |
| 5,062,722 | 11/1991 | Shiozaki et al. | 400/621 |

FOREIGN PATENT DOCUMENTS

| | | |
|---|---|---|
| 58-191176 | 11/1983 | Japan . |
| 60-131275 | 7/1985 | Japan . |
| 63-246265 | 10/1988 | Japan . |
| 2197737A | 5/1988 | United Kingdom . |

*Primary Examiner*—Eugene H. Eickholt
*Attorney, Agent, or Firm*—Oliff & Berridge

[57] ABSTRACT

The invention provides an apparatus capable of automatically changing over continuous paper and cut paper, wherein manual changeover is possible even if an actuator is locked in case of an accidental paper jam, to thus facilitate a processing. A platen gear can be associated with a tractor drive gear via a clutch gear for connecting or disconnecting both gears to or from each other upon oscillation of a clutch lever. The clutch lever is oscillated by a changeover lever which is moved by a changeover cam driven by a stepping motor. Therefor, the changeover cam is manually moved under a normal condition so that the changeover of the continuous paper and the cut paper can be manually performed without any application of a load of the stepping motor.

13 Claims, 12 Drawing Sheets

PRINTER HAVING CONTINUOUS PAPER/CUT PAPER CHANGEOVER APPARATUS

BACKGROUND OF THE INVENTION

1. Field of the Invention

The invention relates to a printer and, more particularly, to a continuous paper/cut paper changeover apparatus in a printer capable of selectively using either of continuous paper and cut paper as the print medium.

2. Description of Related Art

A printer of this type is known where a stepping motor for feeding paper is connected to a platen via a timing belt or the like, a clutch gear is interposed between a platen gear of the platen and a pin feed tractor gear of a pin feed tractor, and the pin feed tractor is rotated upon driving of the platen to feed continuous paper to the platen when the clutch gear is connected to both the platen gear and the pin feed tractor gear by means of a lever of the clutch gear while cut paper is fed to the platen upon driving of the platen when the clutch gear is disconnected from the pin feed tractor gear by means of the clutch lever.

In this case, the switching operation of the clutch lever is generally performed in a manual manner. Additionally, a type printer is known where the clutch lever is switched on the basis of an electric signal that uses a drive source such as the stepping motor. There is also a type printer where an electromagnetic clutch is used and it is switched on the basis of an electric signal.

In a printer where the switching operation of the clutch is performed in a manual manner, considerable time must be taken for the changeover operation between continuous paper and cut paper. Additionally, in a printer where the switching operation of the clutch lever is performed by the drive source, a jam of the continuous paper, or other malfunction, is liable to happen, and consequently, stoppage of the motor results in the clutch lever becoming locked at a time when it is necessary to manually rotate only the platen. Thus, it is difficult to separate the clutch gear from the tractor.

SUMMARY OF THE INVENTION

Accordingly, use of a manual switch lever in addition to the drive source may be attempted. In a structure where the clutch gear is directly connected to the motor gear, as generally provided, the drive source and other members must be operated simultaneously with the operation of the manual lever. This causes a heavy load or difficult operation and complicates the structure because of the need for a mechanism for disconnecting the mechanical switch lever from the drive source and the other members. Moreover, in a printer using an electromagnetic clutch, the manual switching operation becomes difficult since the drive source is connected to the clutch and it also has an attendant problem of the high cost of component parts.

An object of the invention is to enable the switching operation of the clutch gear to be performed either by the drive source, such as the motor, or manually, and to provide a structure simple to operate and in construction.

To achieve the above objects, the invention provides a continuous paper/cut paper changeover apparatus for a printer comprising: a platen; continuous paper feed means for feeding continuous paper to the platen; a paper feed drive source; clutch means for connecting-/disconnecting the continuous paper feed means to/-from a paper feed drive source; automatic continuous paper/cut paper changeover means for automatically switching the clutch means, the automatic continuous paper/cut paper changeover means being movable between an operative position at which said automatic continuous paper/cut paper changeover means is engaged with said clutch means in order to switch said clutch means and an inoperative position at which said automatic continuous paper/cut paper changeover means is disengaged from said clutch means and said clutch means can be moved irrespective of said automatic continuous paper/cut paper changeover means; a changeover drive source connected to the automatic continuous paper/cut paper changeover means; and manual clutch switch means for manually disconnecting the clutch means.

In case of automatic changeover of continuous paper and cut paper, the automatic continuous paper/cut paper changeover means, in cooperation with the operation of the drive source, connects or disconnects the clutch means between the platen and the continuous paper feed means. When the clutch means is connected, the continuous paper feed means is driven, by the operation of the platen, to feed the continuous paper to the platen and when the clutch means is disconnected, cut paper is fed to the platen.

Meanwhile, in case of manual changeover between the continuous paper and the cut paper, the manual clutch switching means is operated to connect or disconnect the clutch means between the platen and the continuous paper feed means. When the clutch means is disconnected, removal of jammed continuous paper or cut paper and other inspecting operations can be performed irrespective of the operation of the drive source. No load can be generated when the clutch means is disconnected, in the manual operation, because the continuous paper/cut paper changeover means is located in a retreated position.

According to the invention, and as apparent from the above description, the changeover operation between the continuous paper and the cut paper can be performed not only by the drive means, such as the motor but also in a manual manner, thereby facilitating corrective actions in case of a paper jam and/or other malfunctions. Further, since the manual operation is performed independently of the drive means, a complicated structure and a difficult operation are avoided.

BRIEF DESCRIPTION OF THE DRAWINGS

The invention will be described with reference to drawings in which.

DETAILED DESCRIPTION OF THE PREFERRED EMBODIMENT

Figure 1:
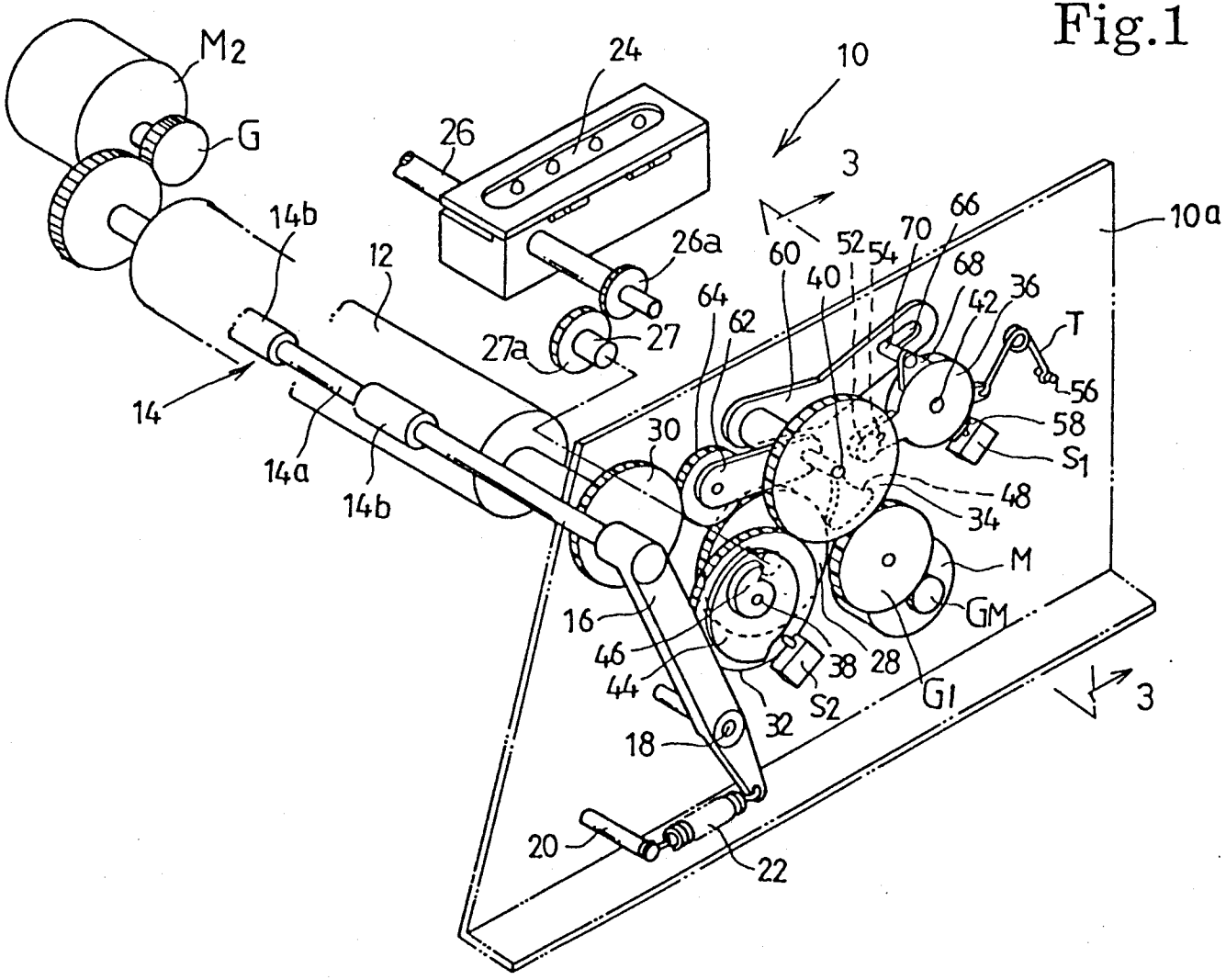
FIG. 1 is a perspective view showing the principal parts of a printer in one preferred embodiment of the invention.

As shown in FIG. 1, in a printer 10, a platen 12 for feeding a print medium of continuous or cut paper is rotatably supported on a pair of side frames (only one side frame 10*a* is shown) disposed opposite to one another. The platen 12 is rotationally driven via a gear G by a motor M2 secured to the non-shown side frame. A paper bail roller 14 is disposed on the platen 12. The paper bail roller 14 is provided with a plurality of paper pressing rollers 14*b*, rotatably attached to a shaft 14*a*, g to feed the print medium while pressing it against the platen 12. The ends of the shaft 14*a* are supported on a first end of paper bail levers 16 (only one paper bail illustrated), each paper bail lever pivotally mounted on a support shaft 18 projecting from the side frame 10*a*, in such a manner as to be brought into contact with or separated from the platen 12. A spring 22 is stretched between the second end of the paper bail lever 16 and a fixing pin 20 projected from the side frame 10*a*. Under normal conditions, the paper bail roller 14 is pressingly urged toward the platen 12 by a contraction force of the spring.

A tractor shaft 26 of a pin feed tractor 24 for continuous paper, which is fed between the side frames, is rotatably supported by the side frames. A shaft 27 extends through side frame 10*a* to be attached to a tractor drive gear 28 that is disposed adjacent to a platen gear 30 which is coaxial with the platen 12. The end of shaft 27, inside of side frame 10*a* and opposite tractor drive gear 28, mounts a secondary tractor gear 27*a* that meshes with and drives gear 26*a* fixedly mounted to tractor shaft 26 which is coaxial with the platen 12.

Also at the outer surface of the side frame 10*a* is a paper bail opening/closing cam gear 32 for bringing the paper bail roller 14 into contact with or separating it from the platen 12, a continuous paper/cut paper changeover cam gear 34 for changing over the feed of the continuous paper and the cut paper, and a continuous paper/cut paper changeover rotor 36 which are rotatably pivoted on support shafts 38, 40, 42, respectively. The paper bail opening/closing cam gear 32 is meshed with the continuous paper/cut paper changeover cam gear 34, which is connected to a forward-/reverse rotation stepping motor M. The stepping motor M is mounted on the side frame 10*a* to drive a gear train, comprising a motor main shaft gear GM and a driven gear GI, which drives continuous paper/cut paper changeover cam gear 34.

The paper bail opening/closing cam gear 32 is provided at its side surface with a switch operating portion 44, for turning a limit switch S2 on or off, and a circular cam portion 46 for pressing the paper bail lever 16 within a rotational range.

At the tip end of a flexible arm plate 50, extending at one side edge of the continuous paper/cut paper changeover rotor 36, is a short shaft portion 52 engageable with a sectorial cam portion 48 of the continuous paper/cut paper changeover cam gear 34, and a ramp or slope 54 leading to the short shaft portion 52. One end of a toggle spring T is hooked on the side edge of the rotor 36 opposite the flexible arm plate 50. The other end of the toggle spring T is hooked on a fixing pin 56 projected from the side frame 10*a* so that the rotor 36 returns to an original rotational position within a dead point of the toggle spring T upon rotation at a given phase angle. At the circumferential edge of the rotor 36, there is also provided a switch operating portion 58 for turning on or off a limit switch S1 disposed close to the rotor 36. The limit switch S1 is adapted to detect the changeover between the continuous paper and the cut paper.

Figure 3:
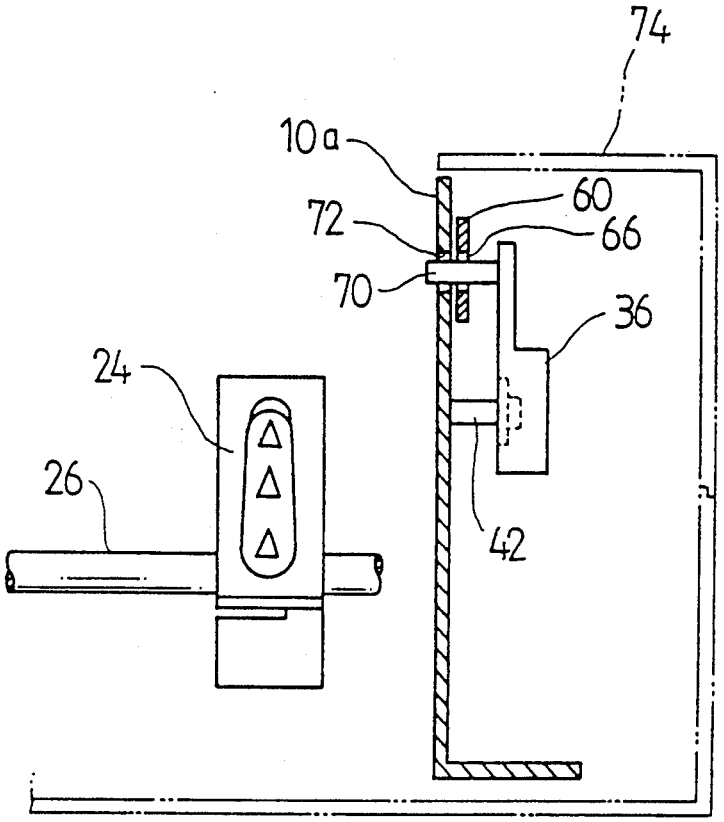
FIG. 3 is a view taken along line 3—3 of FIG. 1.

One end of a clutch lever 60 is pivoted on the support shaft 40 of the continuous paper/cut paper changeover cam gear 34. A clutch gear 64, supported on the tip end of an arm rod 62 extending from the clutch lever 60, is meshed with both of the platen gear 30 and the tractor drive gear 28. A slot 66 is formed at the base end of the clutch lever 60. A changeover pin 70, that projects from an extending support plate 68 attached to continuous paper/cut paper changeover rotor 36, is loosely seated in the slot 66. The changeover pin 70 projects through an opening 72 formed in the side frame 10*a* as depicted in FIG. 3. The platen gear 30 and the clutch gear 64 are structured to have a gear ratio that equalizes the rotational speed of the platen 12 and the continuous paper feed speed of the pin feed tractor 24.

In FIG. 3, reference numeral 74 designates a main unit frame of the printer which encloses the abovementioned component parts.

The operation of the printer in the preferred embodiment according to the invention will be explained hereunder according to the steps executed.

(A) Upon turning on of a power source

Figure 2:
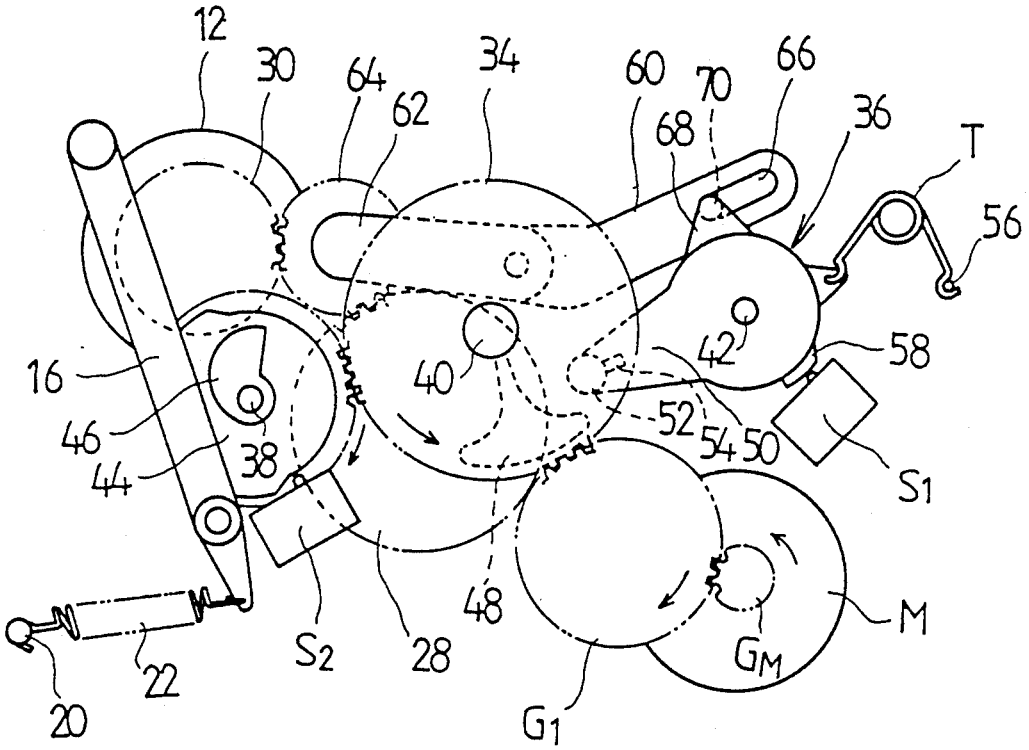
FIG. 2 is a front view of the principal parts of FIG. 1.
Figure 9:
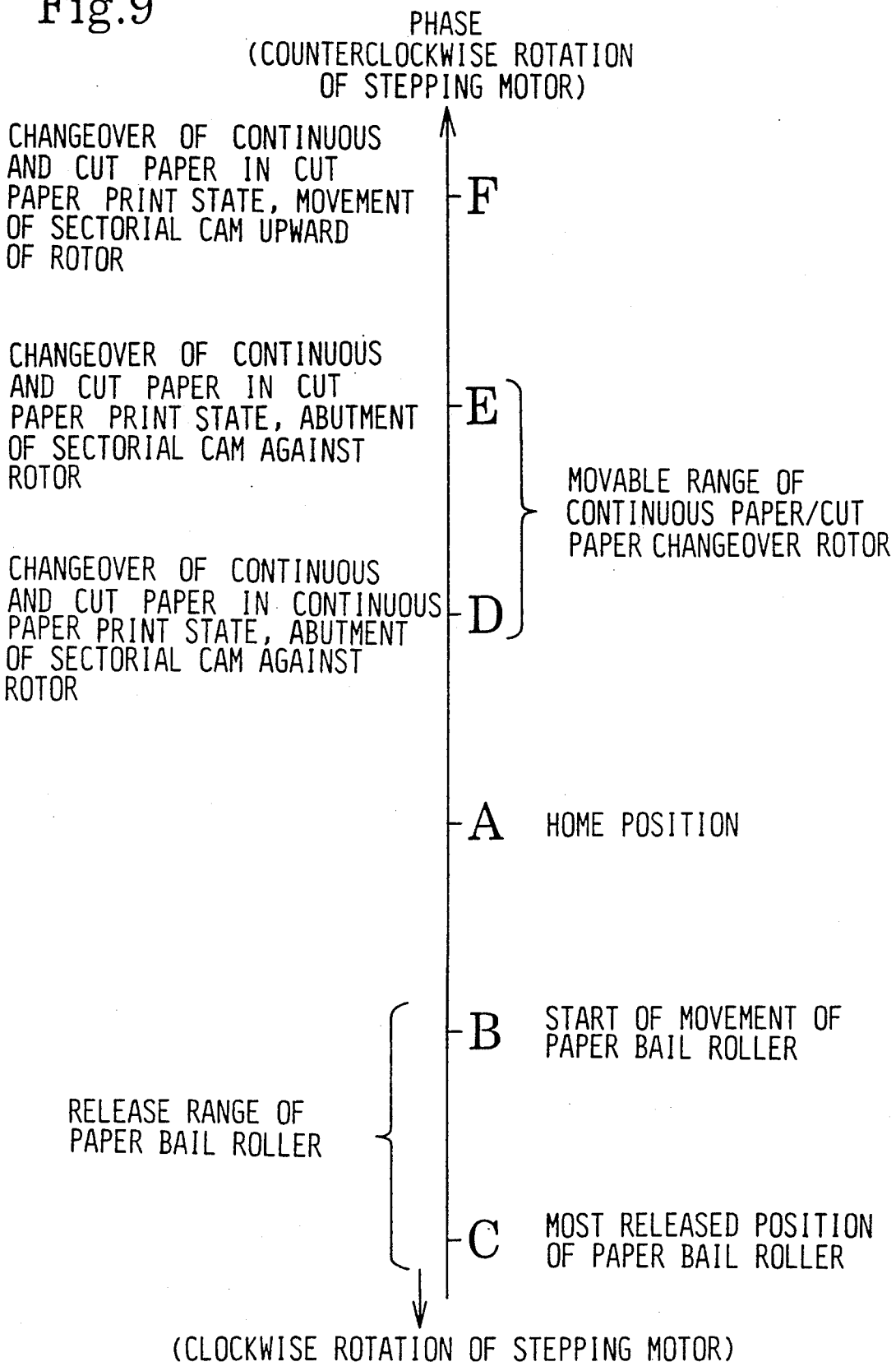
FIG. 9 is an explanatory view of the relationship between a rotational phase of a stepping motor and motion of the paper bail roller or a continuous paper/-cut paper changeover rotor.

Upon turning on a power source in the printer, the ON/OFF state of the limit switch S2 is detected on the basis of an electric signal. When in the ON state, the stepping motor M is rotated counterclockwise (as shown FIG. 2) until the switch operating portion 44 of the paper bail opening/closing cam gear 32 is positioned to change the state of the limit switch S2 to OFF, i.e., the limit switch S2 is separated from switch operating portion 44. When the limit switch S2 is in the OFF state S2, the stepping motor M is rotated clockwise (as shown in FIG. 2) so that the switch operating portion 44 is positioned to change the state of the limit switch S2, and then the rotation of the motor returns by one step. Both positions, which are the same position, are illustrated in FIG. 2 and constitute the home position A of the stepping motor M (see FIG. 9).

(B) Release of the paper bail roller

Figure 4:
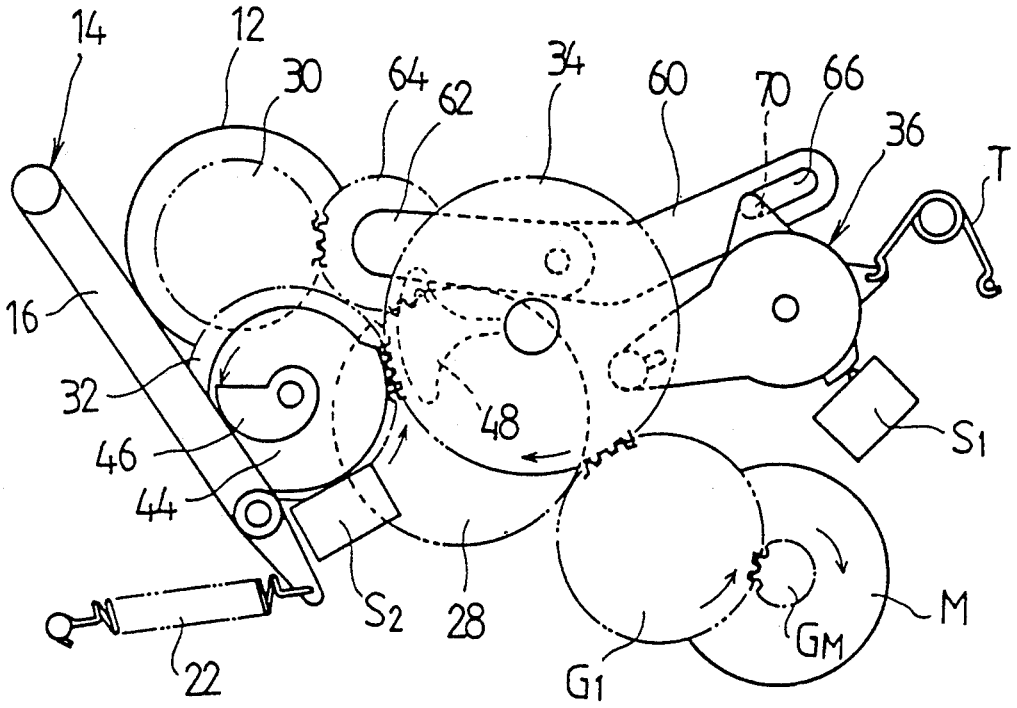
FIG. 4 is a view of assistance in explaining the operation of separating a paper bail roller from a platen.

The paper bail opening/closing cam gear 32 is rotated in the direction indicated by an arrow in FIG. 4 by the drive transmitted by the driven gear GI through the continuous paper/cut paper changeover cam gear 34 from the clockwise rotation of the stepping motor M. The rotational phase of the stepping motor M is phase B (refer to FIG. 9) wherein the circular cam portion 46 abuts against the paper bail lever 16. As the stepping motor M rotates, the paper bail roller 14 is separated from the platen 12 to be moved to the most released state designated phase C (see FIG. 9).

At this time, there is no engaging relationship between the continuous paper/cut paper changeover cam gear 34 and the continuous paper/cut paper changeover rotor 36, the continuous paper can be fed if the clutch gear 64 is meshed with both the platen gear 30 and the tractor drive gear 28. The drive of the platen 12 by the motor M2 allows the tractor drive gear 28 to be rotated so that the drive of the pin feed tractor 24 feeds the continuous paper between the platen 12 and the paper bail roller 14. However, the continuous paper cannot be fed when the clutch gear 64 is separated from the tractor drive gear 28 thereby allowing the cut paper to be fed between the platen 12 and the paper bail lever 16.

Thus, the stepping motor M is rotated counter-clockwise to return to the home position A after passing the paper between the platen 12 and the paper bail roller 14, and consequently, the paper bail roller 14 is moved back by the spring 22, so that the bail roller 14 urges the paper against the platen 12.

(C) Changeover from continuous paper to cut paper

Figure 5:
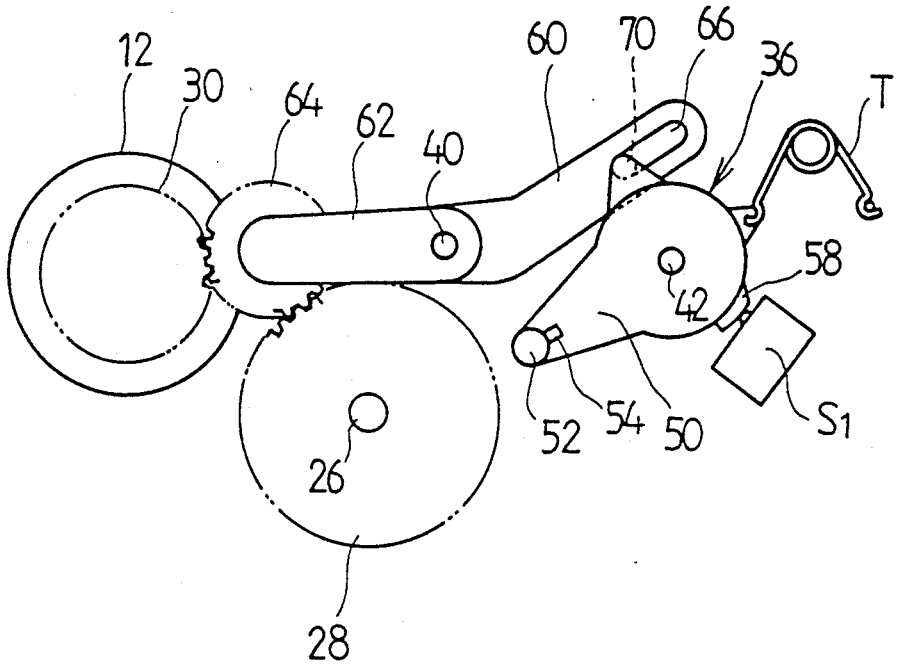
FIG. 5 is a view showing a printable state with respect to continuous paper.
Figure 6:
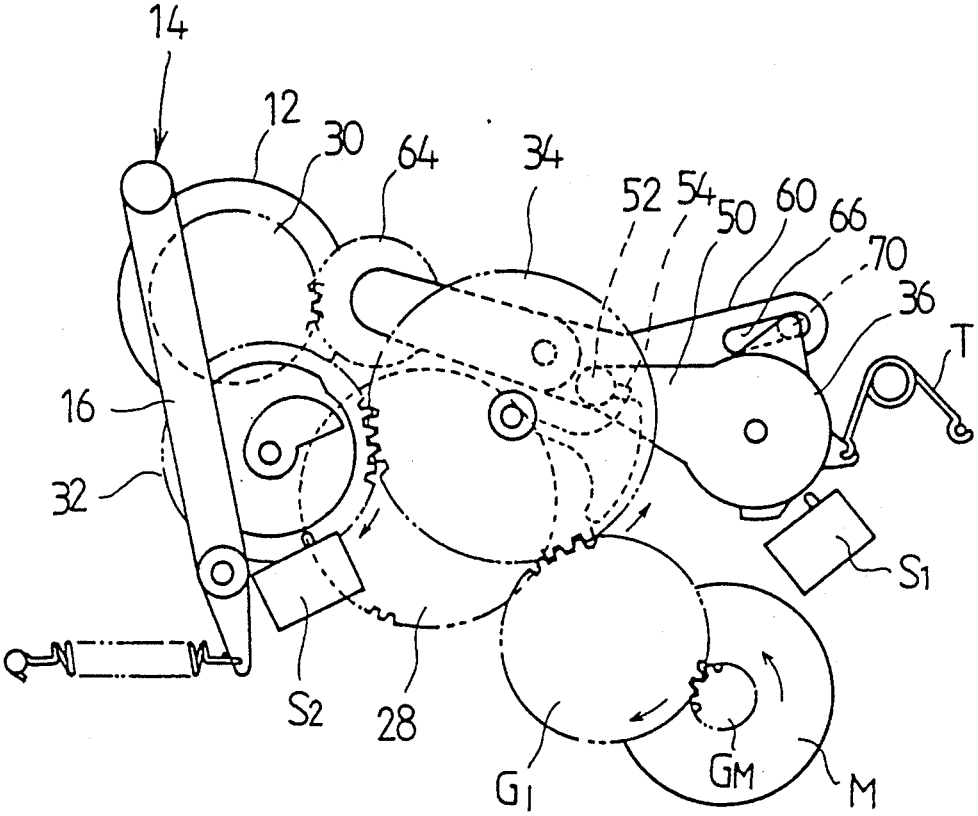
FIG. 6 is a view of assistance in explaining a changeover operation from continuous paper to cut paper.

In a continuous paper print state as shown in FIG. 5, the stepping motor M is rotated counterclockwise from the home position A. In a rotational phase D of the stepping motor M (see FIG. 9), the sectorial cam portion 48 of the continuous paper/cut paper changeover cam gear 34 contacts the short shaft portion 52 of the continuous paper/cut paper changeover rotor 36 so that the rotor 36 is rotated clockwise as illustrated in FIG. 6. In the vicinity of a rotational phase E of the stepping motor M (see FIG. 9), the toggle spring T exceeds the dead point, and, at this time, the clutch lever 60 is turned by the spring force. As a result, the print state is changed over from the continuous paper print state to the cut paper print state. This state is detected by the micro switch S1. The turning of the clutch lever 60 causes the clutch gear 64 to be separated from the tractor drive gear 28 thereby preventing the transmission of the rotation of the platen 12 to the pin feed tractor 24. As a result, the cut paper can be fed to the platen 12.

In the rotational phase E, the rotation of the stepping motor M is changed to the clockwise rotation so that the motor M returns to the home position A and comes to a halt. In the absence of a detection signal indicative of the changeover from the continuous paper to the cut paper by the micro switch S1, an error signal is generated and the absence of the detection signal is displayed on a display 94 shown in FIG. 12.

During the above mentioned operation, because there is no engagement relationship between the paper bail opening/closing cam gear 32 and the paper bail lever 16, the paper bail roller 14 remains pressed against the platen 12.

(D) Changeover from cut paper to continuous paper

Figure 7:
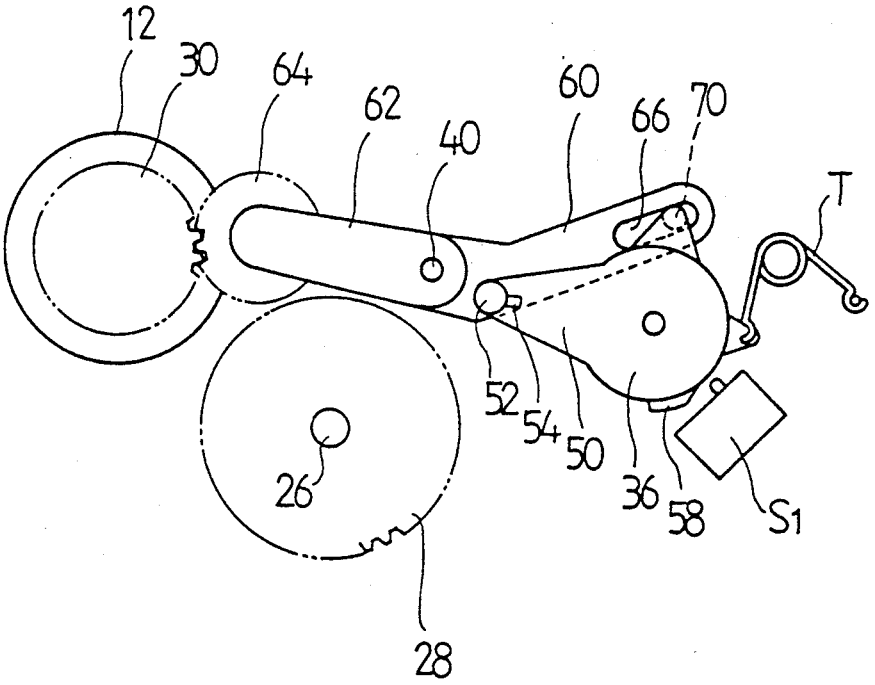
FIG. 7 is a view showing a printable state with respect to cut paper.
Figure 8:
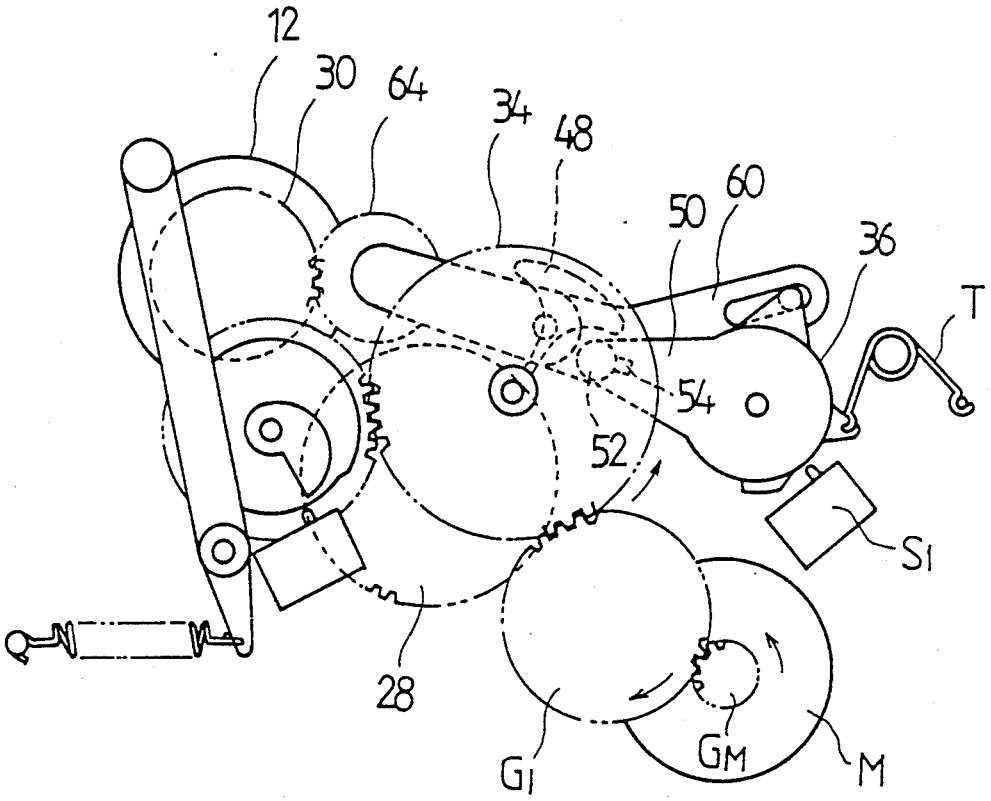
FIG. 8 is a view of assistance in explaining a changeover operation from cut paper to continuous paper.

In a cut paper print state, as depicted in FIG. 7, the stepping motor M is rotated counterclockwise from the home position A, and is further rotated after the sectorial cam portion 48 of the continuous paper/cut paper changeover cam gear 34 abuts against the short shaft portion 52 of the continuous paper/cut paper changeover rotor 36 in the rotational phase E. Consequently, the sectorial cam portion 48 runs over the slope 54 of the rotor 36 to pass over the short shaft portion 52 by the flexible effect of the arm plate 50. As illustrated in FIG. 8, in a position where the sectorial cam portion 48 passes over the short shaft portion 52, i.e., in a rotational phase F of the stepping motor M (refer to FIG. 9), the printer is in the cut sheet feed mode. To return to the continuous feed mode, the motor is rotated in a clockwise direction so that the sectorial cam portion 48 presses down the short shaft portion 52 to rotate the continuous paper/cut paper changeover rotor 36 against the spring force of the toggle spring T. The sectorial cam portion 48 again moves up the slope 54 of the continuous paper/cut paper changeover rotor 36 by the further rotation of the motor to pass over the short shaft portion 52 because of the flexing of the arm plate 50 and comes to a halt at the home position A (the state shown in FIG. 2). As a result, the continuous paper can now be fed to the platen 12.

Figure 12:
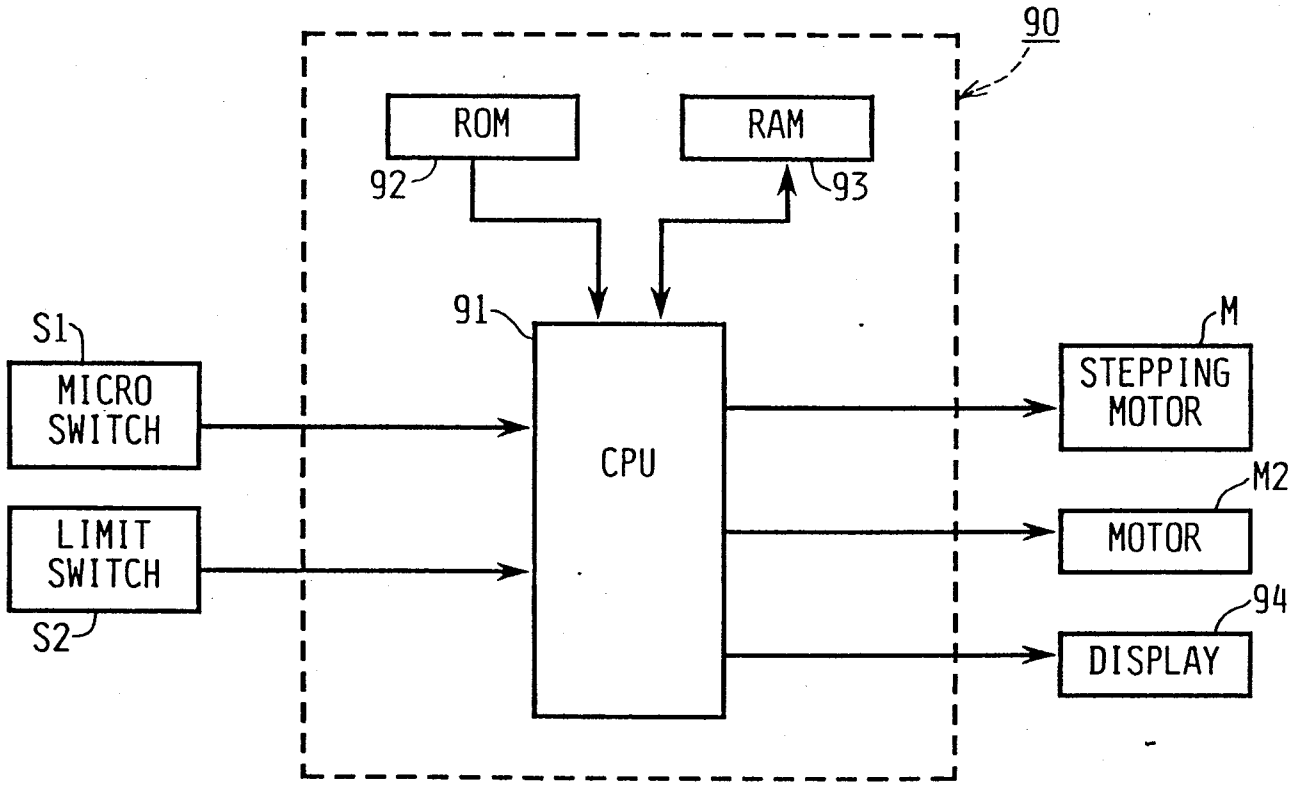
FIG. 12 is a block diagram of the control system.

The number of steps of the stepping motor M from the home position A to the phase B, C, D, E or F positions is stored in a read only memory 92 of a control microcomputer 90, shown in FIG. 12, which controls the printer including the stepping motor M.

(E) Changeover of continuous paper and cut paper in manual manner

Figure 10:
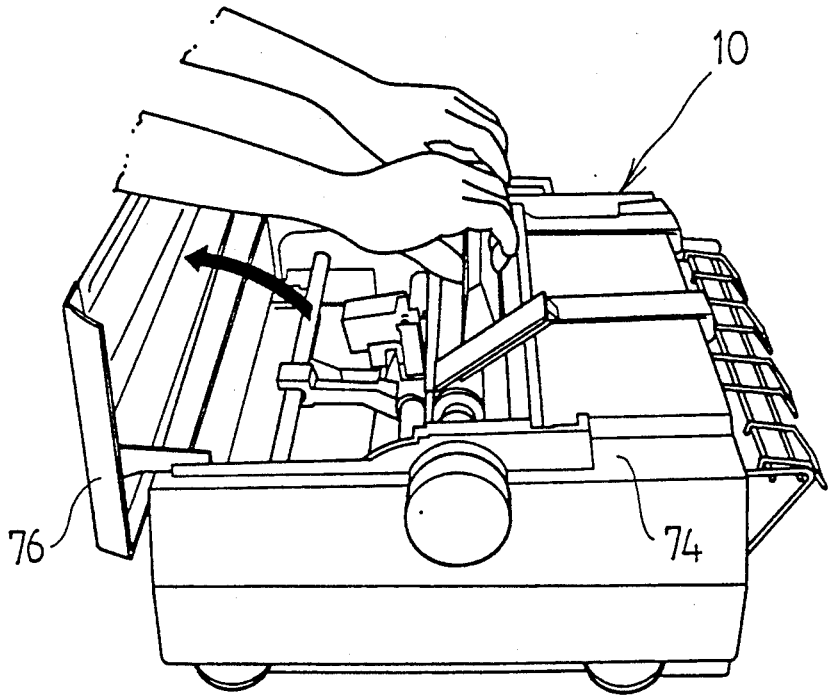
FIG. 10 shows a cover of the printer at the time of inspecting the inside of the printer.

As described above, the stepping motor M always returns to the home position A after completion of the changeover of the continuous paper and the cut paper and the sectorial cam portion 48 of the continuous paper/cut paper changeover cam gear 34 is separated from the continuous paper/cut paper changeover rotor 36. Accordingly, as depicted in FIG. 10, a cover 76 of the printer main unit can be opened and the changeover pin 70 of the continuous paper/cut paper changeover rotor 36 that projects from the side frame **10*a* can be operated by a hand so that the tractor drive gear 28 is separated from the clutch gear 64 if the clutch lever 60 is turned against the spring force of the toggle spring T. Thus, jammed paper can be removed by manually rotating only the platen 12** and other inspections can be executed easily.

At this time, since there is no engaging relationship between the continuous paper/cut paper changeover rotor 36 and the sectorial cam portion 48, there is no load generated on the stepping motor M which is in the locked state.

Although the stepping motor M may be controlled so that it continues to operate in the same manner in the case where a signal for commanding changeover is the same as that detected by the microswitch S1, when the change to the continuous paper/cut paper changeover rotor 36 is a manual operation, it is desirable that the motor M should continue to operate in the previously directed manner should the rotor 36 be unintentionally manually stopped on the dead point of the toggle spring T. Only when the manual changeover of the continuous paper/cut paper changeover rotor 36 is complete and micro switch S1 has completed its movement is a changeover made.

In the printer in the above explained embodiment, a single drive source operates both the paper bail roller and the changeover operation of the continuous paper and the cut paper. This reduces the number of I/O ports of the microcomputer to be used for control. It is effective in the case where a one-chip microcomputer is used.

Figure 11:
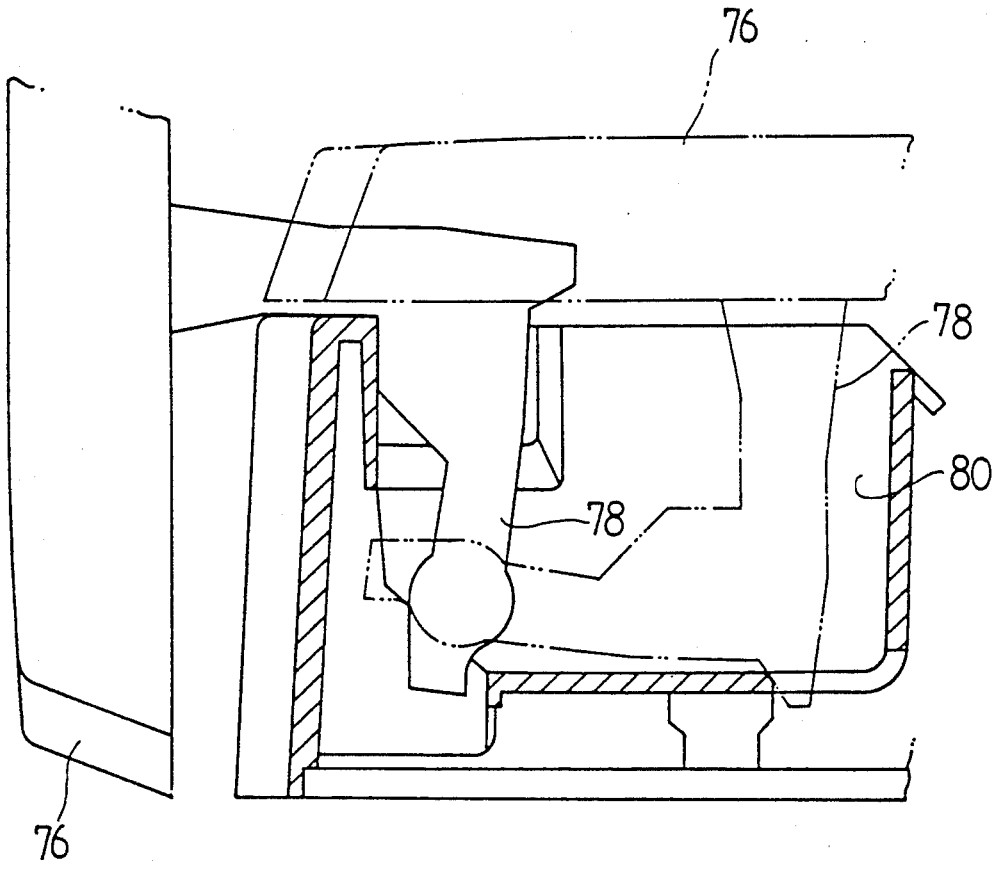
FIG. 11 is a sectional view showing the cover attached in the printer.

FIG. 11 shows a state where the cover 76 of the printer can be locked at one side edge of the printer main unit frame 74. The cover 76 itself is provided with a bent type lock arm 78. A space portion 80 is formed in the printer unit to contain the lock arm 78 inside the printer main unit when the cover 76 is closed as illustrated in the two-dot dash lines of FIG. 11. This structure facilitates removing jammed paper and other inspections.

It is to be understood that the present invention is not restricted to the particular embodiment shown above, and various modifications and alterations can be added thereto.

What is claimed is:

1. A continuous paper/cut paper changeover apparatus for a printer, comprising:

a platen;

continuous paper feed means for feeding continuous paper to said platen;

a paper feed drive source;

clutch means for connecting/disconnecting said continuous paper feed means to/from said paper feed drive source;

automatic continuous paper/cut paper changeover means for automatically switching said clutch means, said automatic continuous paper/cut paper changeover means being movable between an operative position at which said automatic continuous paper/cut paper changeover means is engaged with said clutch means in order to switch said clutch means and an inoperative position at which said automatic continuous paper/cut paper changeover means is disengaged from said clutch means and said clutch means can be moved irrespective of said automatic continuous paper/cut paper changeover means;

a changeover drive source connected to said automatic continuous paper/cut paper changeover means;

manual clutch switch means for manually disconnecting said clutch means.

2. The apparatus as claimed in claim 1, wherein said clutch means comprises:

a first lever pivotally mounted to a side frame of the printer;

a clutch gear mounted at an end of said first lever away from the pivotal mount;

a second lever pivotally mounted to the side frame of the printer to form an extension of said first lever, said second lever having an elongated slot in an angled arm away from the pivotal mount; and an automatic continuous paper/cut paper changeover means having a changeover pin engaged with said slot, wherein said clutch gear is capable of engaging said paper feed drive source and said continuous paper feed means.

3. The apparatus as claimed in claim 2, wherein said changeover drive source comprises:

a step motor;

a drive gear attached to a drive shaft of said step motor; and an intermediate gear meshed with said drive gear.

4. The apparatus as claimed in claim 3, wherein said automatic continuous paper/cut paper changeover means, further comprises:

a cam gear meshed with said intermediate gear; and a changeover rotor having a flexible arm plate extending toward said cam gear.

5. The apparatus as claimed in claim 4, wherein said cam gear has a cam on an inner surface thereof for engaging a shaft portion mounted on an end of an extension of said changeover rotor, said engagement between said shaft portion and said cam moving said automatic continuous paper/cut paper changeover means such that said pin of said automatic continuous paper/cut paper changeover means moves in said slot of said second clutch lever thereby rotating said first and second clutch levers to separate said clutch gear from said continuous paper feed means.

6. The apparatus as claimed in claim 5, wherein said changeover pin extends through an opening in a side frame of the printer for manual operation.

7. The apparatus as claimed in claim 4, wherein said flexible arm plate has a short shaft portion mounted to an end surface closest to said cam gear and a sloped surface between an upper end of said short shaft portion and the surface of said flexible arm plate and said cam gear has a cam surface for engaging said sloped surface and said short shaft portion.

8. The apparatus as claimed in claim 1, wherein said paper feed drive source also drives said platen.

9. The apparatus as claimed in claim 1, further comprising a control means for controlling a changeover from feed of one of a cut paper and the continuous paper to the other of the cut paper and the continuous paper by controlling said changeover drive source.

10. The apparatus as claimed in claim 9, wherein said control means in response to a changeover command causes said changeover means to switch said clutch means and then return said changeover means to the inoperative position.

11. A printer, comprising:

a printer body;

a printer frame mounted in said printer body and having two side frames;

a platen rotatably supported between said side frames;

continuous paper feed means for feeding continuous paper to said platen;

a paper feed drive source connected to said platen for rotating said platen;

clutch means for connecting/disconnecting said continuous paper feed means to/from said paper feed drive source;

automatic continuous paper/cut paper changeover means for automatically switching said clutch means, said automatic continuous paper/cut paper changeover means being movable between an operation position at which said automatic continuous paper/cut paper changeover means is engaged with said clutch means in order to switch said clutch means and an inoperative position at which said automatic continuous paper/cut paper changeover means is disengaged from said clutch means and said clutch means can be moved irrespective of said automatic continuous paper/cut paper changeover means;

a changeover drive source connected to said automatic continuous paper/cut paper changeover means;

manual clutch switch means for manually disconnecting said clutch means.

12. The printer as claimed in claim 11, further comprising a control means for controlling a changeover from feed of one of a cut paper and the continuous paper to the other of the cut paper and the continuous paper by controlling said changeover drive source.

13. The printer as claimed in claim 12, wherein said control means in response to a changeover command causes said changeover means to switch said clutch means and then return said changeover means to the inoperative position.

* * * * *